US007845578B2

(12) United States Patent
Cox et al.

(10) Patent No.: US 7,845,578 B2
(45) Date of Patent: Dec. 7, 2010

(54) RAILWAY RAIL FASTENING CLIP

(75) Inventors: Stephen John Cox, Richmond (GB); Martin Somerset, Worksop (GB); Paul Hewlett, Langold (GB); Christopher Gardner, Worksop (GB)

(73) Assignee: Pandrol Limited, Addlestone, Surrey (GB)

( * ) Notice: Subject to any disclaimer, the term of this patent is extended or adjusted under 35 U.S.C. 154(b) by 0 days.

(21) Appl. No.: 12/279,769

(22) PCT Filed: Feb. 21, 2007

(86) PCT No.: PCT/GB2007/000610

§ 371 (c)(1),
(2), (4) Date: Nov. 14, 2008

(87) PCT Pub. No.: WO2007/096620

PCT Pub. Date: Aug. 30, 2007

(65) Prior Publication Data

US 2009/0065599 A1 Mar. 12, 2009

(30) Foreign Application Priority Data

Feb. 21, 2006 (GB) ..... 0603434.2

(51) Int. Cl.
*E01B 9/30* (2006.01)

(52) U.S. Cl. ..... 238/349; 238/351

(58) Field of Classification Search ..... 238/310, 238/349, 351, 338, 343, 352
See application file for complete search history.

(56) References Cited

U.S. PATENT DOCUMENTS 3,471,118 A 10/1969 Bormann
3,581,990 A 6/1971 Kirik
3,876,141 A 4/1975 French
4,061,270 A 12/1977 Wandrisco
4,239,156 A 12/1980 Skinner et al.
4,632,307 A 12/1986 Vossloh
4,907,740 A 3/1990 Vossloh
4,915,299 A * 4/1990 Harkus ..... 238/351
5,474,233 A 12/1995 Cailliau
5,520,330 A 5/1996 Pandrol
5,566,882 A 10/1996 Pandrol
5,735,458 A * 4/1998 Brown et al. ..... 238/343
6,702,192 B2 4/2004 Igwemezie

FOREIGN PATENT DOCUMENTS

DE 658902 3/1938

(Continued)

OTHER PUBLICATIONS

International Search Report and Written Opinion of The International Searching Authority, corresponding to International application No. PCT/GB07/000606, no date.

(Continued)

*Primary Examiner*—Mark T Le
(74) *Attorney, Agent, or Firm*—Husch Blackwell LLP Welsh & Katz

(57) ABSTRACT

A substantially M-shaped rail clip is substantially flat when in its non-operative configuration, and, when the clip is in an operative configuration, the toe of the clip lies substantially in a second plane and the legs of the clip lie substantially in a third plane, the second and third planes being non-parallel to one another.

12 Claims, 5 Drawing Sheets

FOREIGN PATENT DOCUMENTS

| | | |
|---|---|---|
| DE | 2813819 | 10/1979 |
| DE | 8804426 | 6/1988 |
| DE | 3820243 | 2/1990 |
| EP | 826826 | 3/1998 |
| FR | 2450902 | 10/1980 |
| GB | 2106570 | 4/1983 |
| GB | 2117035 | 10/1983 |
| GB | 2239035 | 10/1983 |
| GB | 2235003 | 2/1991 |
| GB | 2261241 | 5/1993 |
| GB | 2351515 | 1/2001 |
| GB | 2358423 | 7/2001 |
| JP | 2002121701 | 4/2002 |
| WO | WO 93/12294 | 6/1993 |
| WO | WO 93/12295 | 6/1993 |
| WO | WO 93/12296 | 6/1993 |
| WO | WO 03/101693 | 12/2003 |
| WO | WO 2005/106124 | 11/2005 |

OTHER PUBLICATIONS

UK Patent Search Report of the UK Patent Office, corresponding to UK application No. 0603434.2, Sep. 2006.

EPO Standard Search Report issued on priority UK application No. 0603434.2, dated Sep. 8, 2006.

EPO Standard Search Report issued on priority UK application No. 0603434.2, dated Sep. 12, 2006.

* cited by examiner

RAILWAY RAIL FASTENING CLIP

FIELD OF THE INVENTION

The present invention relates to a railway rail fastening clip.

BACKGROUND OF THE INVENTION

In the documents WO93/12294, WO93/12295 and WO93/12296, the present applicants disclosed a railway rail fastening system in which a rail fastening clip is driven laterally onto the rail and can be held in a clip anchoring device (shoulder) in a "pre-assembly" or "parked" position in which the toe portion of the clip does not bear on the rail. This enables railway sleepers to be preloaded at the factory with clips which are held in the pre-assembly position such that when the sleepers are delivered to site the clips can simply be driven home once the rail is in place. In addition, when maintenance of the rail or sidepost insulators (which lie between the rail and the shoulder) is subsequently required, the clip can be driven off the rail back into the pre-assembly position, or further into an "insulator-change position" in which the clip does not overlie the sidepost insulator, so complete withdrawal of the clip from the shoulder is not necessary. Such clips are sometimes known as "switch-on/switch-off" clips. Such a fastening system has proved to be very successful, but the applicant is desirous of making improvements to some aspects of its manufacture and use.

WO93/12294, WO93/12295 and WO93/12296 disclose a resilient railway rail fastening clip for fastening a railway rail to an underlying foundation, the clip being such that it can be deflected from a non-operative configuration to at least one operative configuration in which a toe portion of the clip bears on a railway rail, in which the clip is made from a rod of resilient material shaped so as to have, proceeding from one end A of the rod to the other end B of the rod, firstly a substantially straight first portion, then a substantially bent second portion, then a third portion, then a fourth portion which is substantially U-shaped and forms the toe portion of the clip, then a fifth portion, then a substantially bent sixth portion, and finally a substantially straight seventh portion, the first and seventh portions of the clip forming leg portions, the longitudinal axes of which lie substantially in a first plane when the clip is in its non-operative configuration and, when the clip is viewed in a direction perpendicular to the said first plane, the third and fifth portions appear to lie between the first and seventh portions. In the prior art the clip is such that in its non-operative configuration the third, fourth and fifth portions of the clip lie in a second plane inclined to the first plane, and, when the clip is in its operative configuration, the third, fourth and fifth portions of the clip lie in a third plane, where the second plane is identical to, or spaced from and parallel to, the first. However, it is desirable to reduce the cost of manufacturing such clips.

BRIEF SUMMARY OF THE INVENTION

Thus, according to the present invention, unlike the prior art clips described above, when the clip is in its non-operative configuration, the longitudinal axes of the second, third, fourth, fifth and sixth portions also lie substantially in the said first plane, and, when the clip is in the said at least one operative configuration, the longitudinal axes of the third, fourth and fifth portions lie substantially in a second plane and the longitudinal axes of the first and seventh portions lie substantially in a third plane, the second and third planes being non-parallel to one another.

Such a clip, which is substantially flat when not in use, has significantly better fatigue performance than an otherwise similar clip formed with some profile, and can be manufactured with less material to achieve the same toe load.

Desirably, the clip is substantially M-shaped in plan, the region joining the inner legs of the M forming the toe portion of the clip and the outer legs of the M forming the leg portions of the clip.

Most preferably, the clip is provided with clip retaining means for inhibiting unintentional withdrawal of the clip from the rail. The clip retaining means are desirably also operable to retain the clip in a pre-assembly position in which the clip does not bear on the rail. The clip retaining means may be provided on the said leg portions of the clip.

Desirably, the surface of the clip is provided with a protective coating, except for that part of the toe portion of the clip which is to contact an insulating member carried by the clip for electrically insulating the clip from the rail. If the toe of the clip, which is subsequently covered by the toe insulator, is left unpainted, then the force required to extract the toe insulator is increased and so further diminishes any possibility of its working loose in service.

Reference will now be made, by way of example, to the accompanying drawings in which:

BRIEF DESCRIPTION OF THE DRAWINGS

FIG. 2 shows a railway rail fastening assembly employing a clip embodying the present invention, in which

DETAILED DESCRIPTION OF THE INVENTION

Figure 1A:
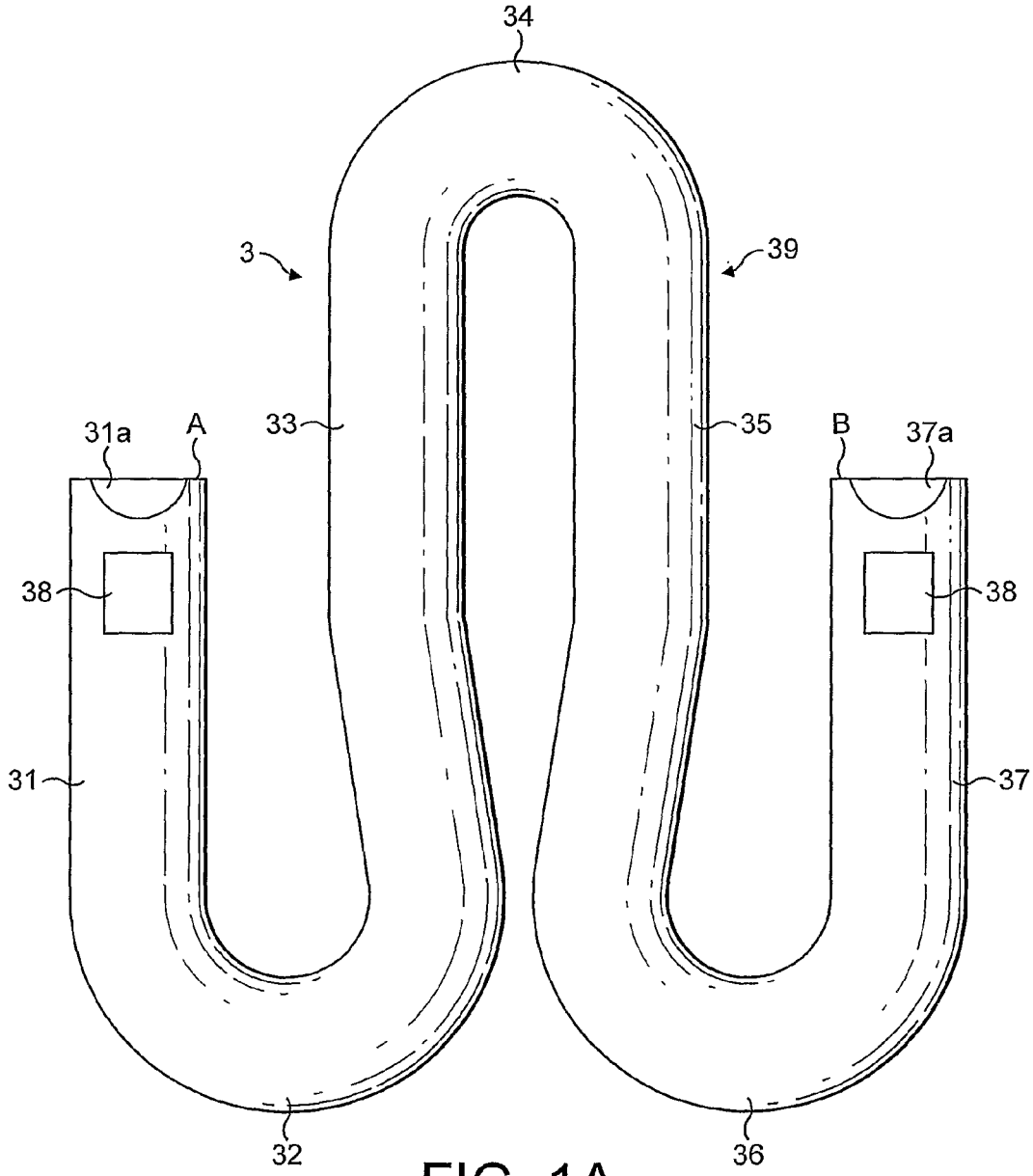
FIG. 1 shows a railway rail fastening clip embodying the present invention, FIG. 1A showing a plan view of the clip, FIG. 1B showing a side view of the clip when in its non-operative configuration and FIG. 1C showing a side view of the clip when in an operative configuration.

A railway rail fastening clip 3 embodying the present invention will now be described with reference to FIGS. 1A to 1C. The rail clip 3 is formed from a steel rod bent so as to have, proceeding from one end A of the rod to the other end B of the rod, firstly a straight first portion 31 forming one leg of the clip, then a bent second portion 32 which bends through more than 180°, then a third portion 33, then a fourth portion 34 which forms the toe portion of the clip and is bent through 180°, then a fifth portion 35 which mirrors the shape of the third portion 33, then a sixth portion 36 which mirrors the shape of the second portion 32 and finally a seventh portion 37 which forms the other leg of the clip. Thus, when viewed as seen in FIG. 7A, the clip may be considered to be substantially M-shaped. The free ends A, B, of the rod have a chamfer 37*a* on the surface of the leg which is to be uppermost when the clip 3 is bearing on a rail for assisting in inserting the clip into the shoulder. Adjacent to the ends A, B, on the uppermost surface of the clip 3, the clip 3 is formed with detents 38 for cooperating with the projections 110A, 110B formed on the walls 10 of the shoulder 1 to retain the clip 3. The detents 38 are formed so as to have two oppositely-inclined spaced-apart faces defining respective pre-assembly and insulator-change positions relative to the shoulder 1.

Figure 1B:
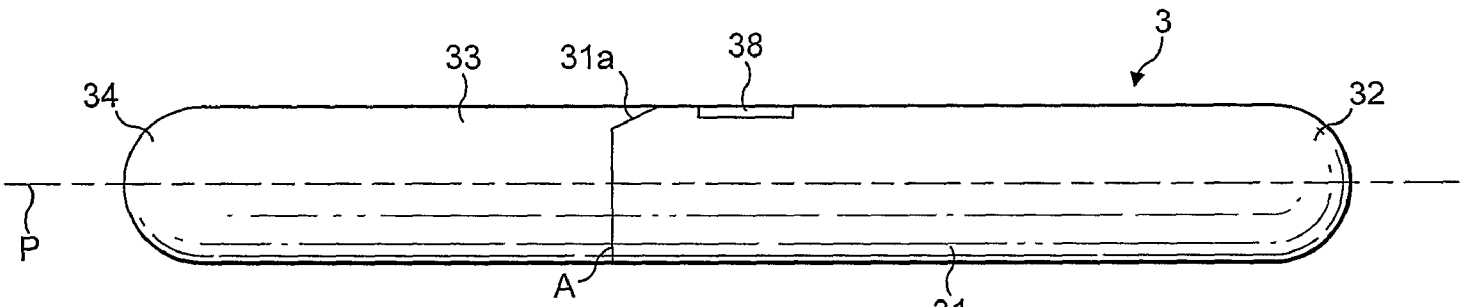
Figure 1C:
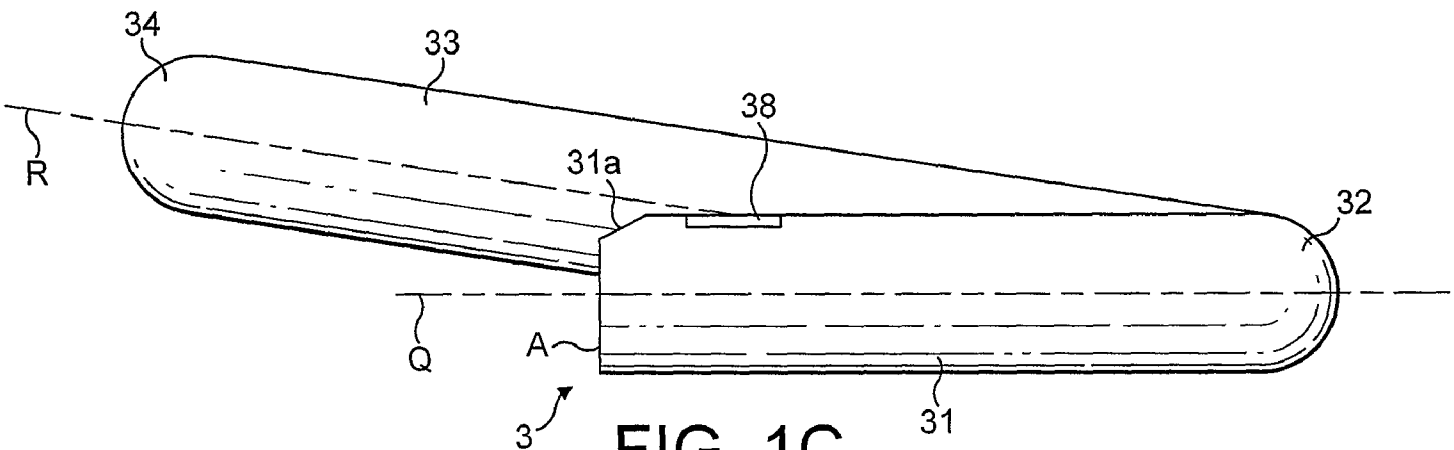

Although not shown in FIGS. 1A to 1C, but seen from FIGS. 2A to 2F, the toe portion 34 of the clip 3 when in use normally carries a toe insulator 34*a* for insulating the clip 3 from the rail. The toe insulator 34*a* also extends over parts of the third and fifth portions, 33, 35 of the clip 3. In order to reduce the likelihood that the toe insulator 34*a* may be removed unintentionally from the clip 3, those portions of the toe portion 34 and third and fifth portions 33, 35 which come into contact with the toe insulator 34*a* when it is located on the clip 3 may be left free of the coating which is generally applied to the remainder of the clip.

When the clip 3 is in its non-operative configuration, i.e. a non-stressed configuration in which the clip is not in use, the longitudinal axes of all parts of the clip lie substantially in the same plane P, that is the clip is flat.

As shown in FIG. 1C, when the clip 3 is deflected into an operative configuration, by driving the clip into a shoulder 1, the legs 31, 37 of the clip 3 are driven downwards out of the first plane P into a second plane Q and the third, fourth and fifth portions 33, 34, 35 of the clip 3 are deflected upwardly out of the plane P into a third plane R, the planes P, Q, R being non-parallel.

Compared to the applicant's prior art switch-on/switch-off clip, a clip embodying the present invention may be made from 14 mm diameter bar instead of 15 mm. In addition, the clip is smaller in plan view, both shorter by about 10 mm and narrower by about 10 mm. The clip may be rolled around smaller radius formers to make the arches of the clip, in particular at the toe of the clip, as a consequence of which, and the smaller diameter, the clip may be significantly lighter. It also operates at a slightly higher stress level. The clip may be initially produced with some profile and then cold-set so that it returns to a flat shape (i.e. over-pressed when cold such that it yields and takes on some permanent deformation).

Figure 2A:
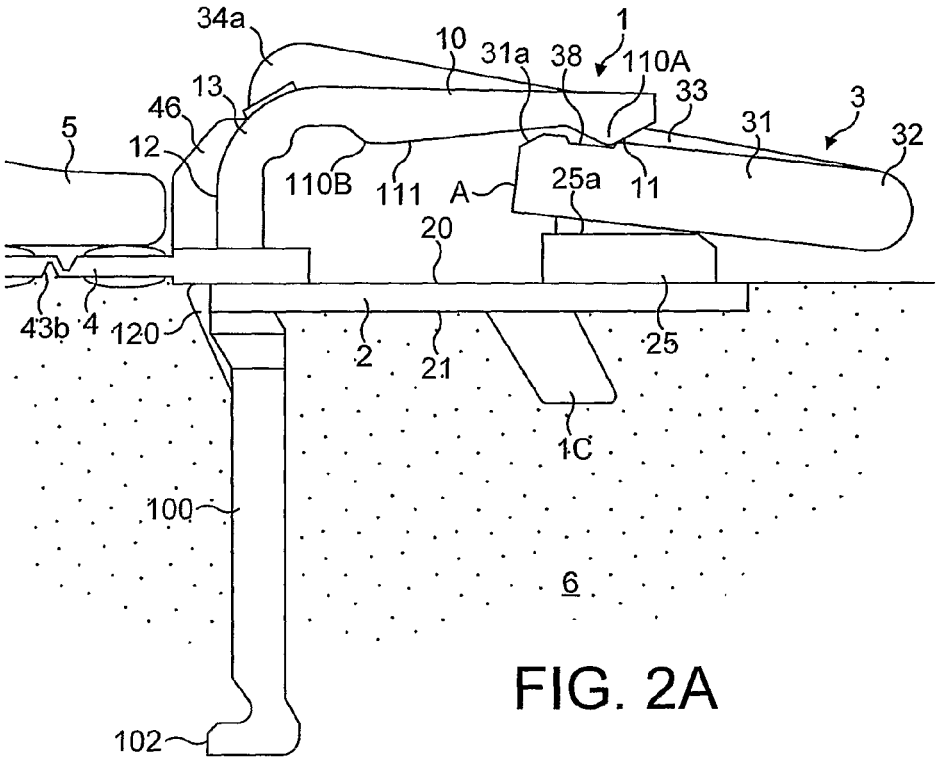
FIGS. 2A and 2B show the assembly in a side view in which the clip is in a pre-assembly position with respect to the rail, FIG. 2B being a part cross-sectional view.
Figure 2B:
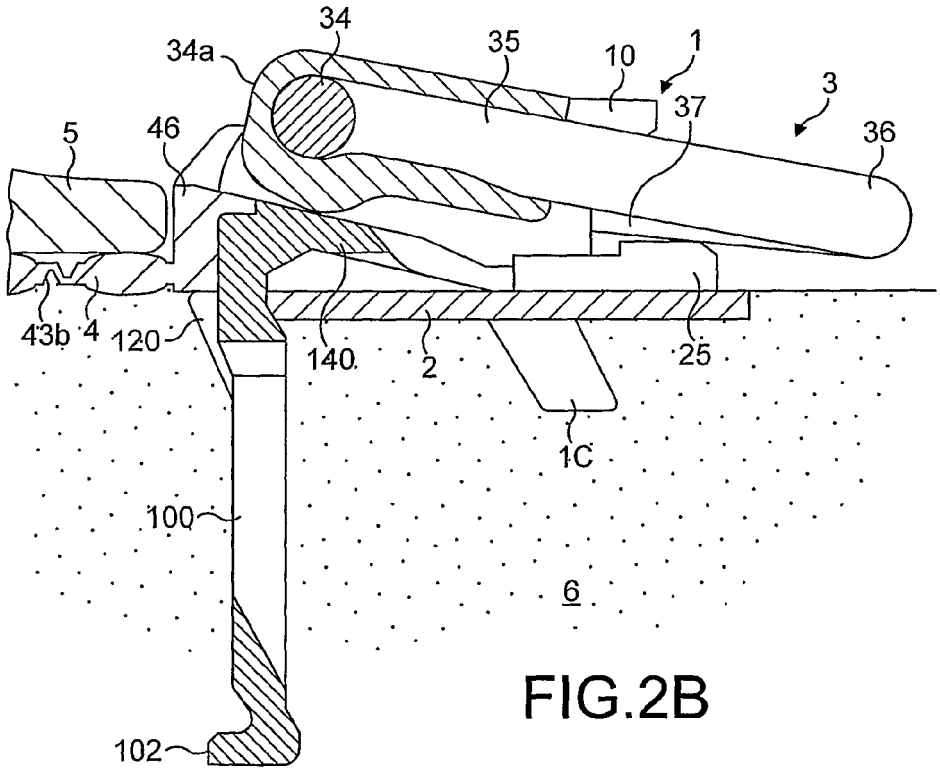

A railway rail fastening assembly employing the clip described above will now be described with reference to FIGS. 2A to 2F. The railway rail fastening assembly of FIGS. 2A to 2F, for fastening a railway rail 5, comprises a shoulder 1, a rail fastening clip 3 embodying the present invention, a sealing plate 2 and a rail pad 4. It will be appreciated that, although not shown in FIGS. 2A to 2F, when in use the rail is fastened on both sides of the rail head by such an assembly and that the stem 1B and tangs 1C are embedded in the concrete sleeper 6. The sealing plate 2 is also embedded in the concrete sleeper 6, such that the top face of sealing plate 2 is flush with the upper surface of the sleeper 6. As shown in FIGS. 2A/2B the clip 3 may be driven into the shoulder 1 by introducing the chamfered free ends A, B of the clip legs 31, 37 into the gaps between the top surfaces 25*a* of the clip seat projections 25 on the sealing plate 2 and the first projection 110A on the outer surface of the walls 10 of the shoulder 1, and inserting the toe portion 34 of the clip 3, bearing a toe insulator 34*a*, into the space between the inner surfaces of the walls 10 of the shoulder 1, such that the toe 34 of the clip 3, through the toe insulator 34*a*, bears on the ramp 140 of the shoulder 1 and the projections 110A are located within the detents 38 in the clip legs 31, 37, with the projection 110A contacting the rear face of the detent 38. This position is known as the "pre-assembly" or "parked" position, in which the clip does not bear on the rail 5, but overlies the shelf 47 of the side post insulator portion 46 of pad 4. Downwardly-facing parts of the legs 31, 37 rest on the top surfaces 25*a* of the clip seat projections 25.

Figure 2C:
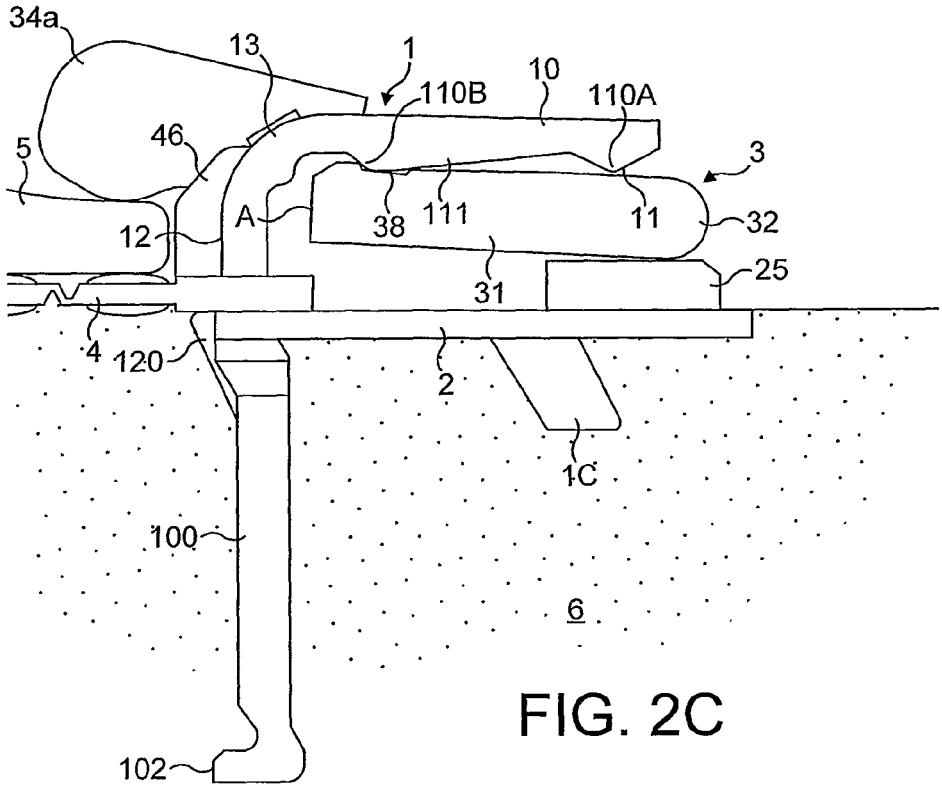
FIGS. 2C and 2D show another side view of the assembly in which the clip is bearing on the rail, FIG. 2D being a part cross-sectional view.
Figure 2D:
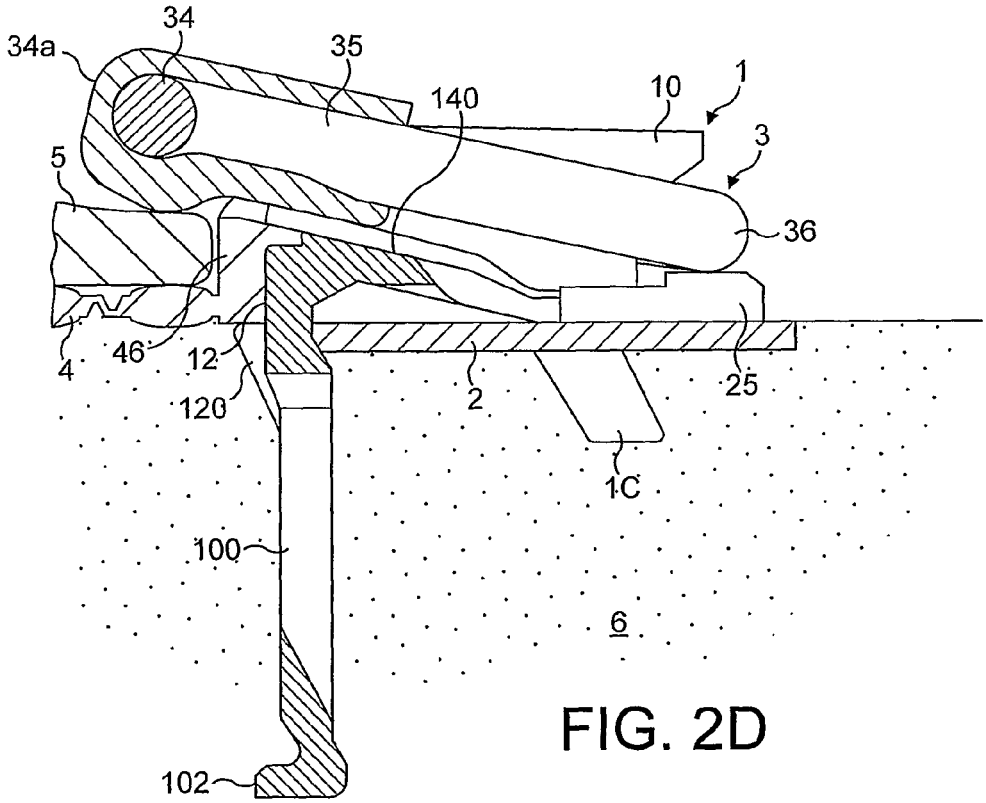
Figure 2E:
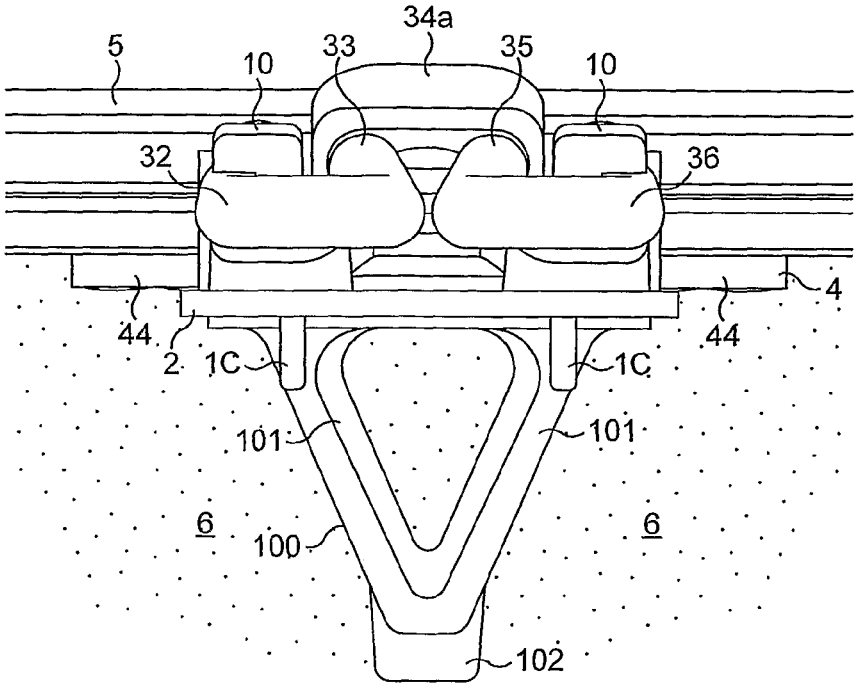
FIG. 2E shows a rear view of the assembly and FIG. 2F shows a perspective view of the assembly.
Figure 2F:
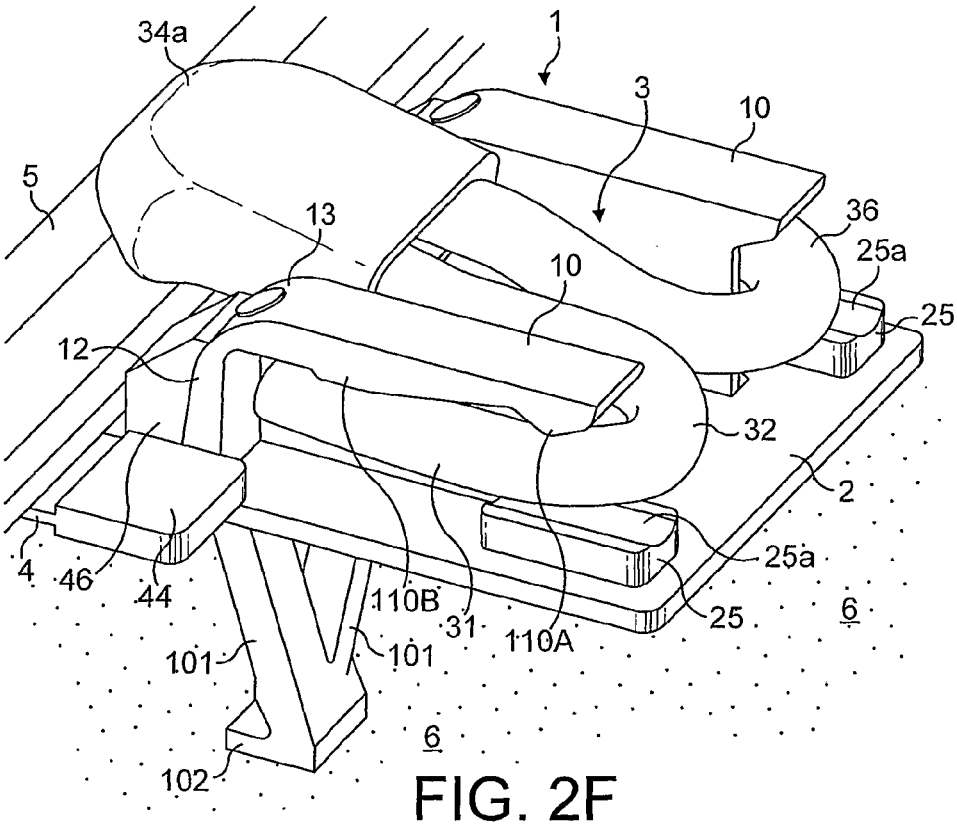

As shown in FIGS. 2C and 2D, the clip 3 can be driven from the pre-assembly position (first operative position) into a second operative position in which the toe portion 34 of the clip 3 bears on the foot of the rail 5, the second projections 110B on the walls 10 engage the detents 38 of legs 31, 37 of the clip 3 and the second and sixth portions 32, 36 (heel portions) of the clip 3 bear on the top surfaces 25*a* of the clip seat projections 25. The clip overlies the shelf 47 of the side post insulator portion 46 of the rail pad 4. The clip can be withdrawn from this position back into the pre-assembly position, if required in order to remove or work on the rail, or further back into the "insulator-change" position in which the front face of the detent 38 contacts the projection 110A and the clip 3 does not overlie the shelf 47 of the sidepost insulator portion 46 of pad 4.

As the clip 3 is installed, the toe 34 of the clip 3 is driven upwards by the ramp 140 in the centre of the shoulder 1, and the legs 31, 37 are driven down, thereby splitting the clip open. This makes it possible to make the assembly a little lower than would otherwise be possible.

We claim:

1. A resilient railway rail fastening clip for fastening a railway rail to an underlying foundation in combination with a shoulder, wherein the clip has a non-operative configuration to and at least one other configuration in which a toe portion of the clip bears on an upper part of an inclined ramp of the shoulder and wherein, the clip being made from a rod of resilient material shaped so as to have, proceeding from one end A of the rod to the other end B of the rod, firstly a substantially straight first portion, then a substantially bent second portion, then a third portion, then a fourth portion which is substantially U-shaped and forms the toe portion of the clip, then a fifth portion, then a substantially bent sixth portion, and finally a substantially straight seventh portion, the first and seventh portions of the clip forming leg portions, the longitudinal axes of which first and seventh portions lie substantially in a first plane when the clip is in its non-operative configuration and, when the clip is viewed in a direction perpendicular to the said first plane, the third and fifth portions appear to lie between the first and seventh portions, characterised in that, when the clip is in its non-operative configuration, the longitudinal axes of the second, third, fourth, fifth and sixth portions also lie substantially in the said first plane, and, when the clip is in the said at least one other configuration, the longitudinal axes of the third, fourth and fifth portions lie substantially in a second plane and the longitudinal axes of the first and seventh portions lie substantially in a third plane, the second and third planes being non-parallel to one another, said inclined ramp positioning said third, fourth and fifth portions in said second plane.

2. The combination as claimed in claim 1, wherein the said clip is substantially M-shaped in plan, the region joining the inner legs of the M forming the said toe portion of the clip and the outer legs of the M forming the said leg portions of the clip.

3. The combination as claimed in claim 1, wherein the combination is provided with clip retaining mechanism for inhibiting unintentional withdrawal of the clip from the rail.

4. The combination as claimed in claim 2, wherein the combination is provided with clip retaining mechanism for inhibiting unintentional withdrawal of the clip from the rail.

5. The combination as claimed in claim 1, wherein the said clip retaining mechanism are also operable to retain the clip in a pre-assembly position in which the clip does not bear on the rail.

6. The combination as claimed in claim 2, wherein the said clip retaining mechanism are also operable to retain the clip in a pre-assembly position in which the clip does not bear on the rail.

7. The combination as claimed in claim 3, wherein the said clip retaining mechanism are also operable to retain the clip in a pre-assembly position in which the clip does not bear on the rail.

8. The combination as claimed in claim 4, wherein the said clip retaining mechanism are also operable to retain the clip in a pre-assembly position in which the clip does not bear on the rail.

9. The combination as claimed in claim 3 wherein the said clip retaining mechanism are provided on the said leg portions of the clip.

10. The combination as claimed in claim 4 wherein the said clip retaining mechanism are provided on the said leg portions of the clip.

11. The combination as claimed in claim 5, wherein the said clip retaining mechanism are provided on the said leg portions of the clip.

12. The combination as claimed in claim 1, wherein the surface of the clip is provided with a protective coating, except for that part of the toe portion of the clip which is to contact an insulating member carried by the clip for electrically insulating the clip from the rail.

* * * * *